US005970887A

United States Patent [19]

Hardy

[11] Patent Number: 5,970,887

[45] Date of Patent: Oct. 26, 1999

[54] ANTI-RACKING PULL-OUT SHELF

[75] Inventor: Stephen N. Hardy, Wadsworth, Ohio

[73] Assignee: RTC Industries, Inc., Rolling Meadows, Ill.

[21] Appl. No.: 08/969,975

[22] Filed: Nov. 13, 1997

[51] Int. Cl.[6] ..... A47F 5/00

[52] U.S. Cl. ..... 108/108; 108/143; 211/187

[58] Field of Search ..... 108/105, 108, 108/143, 147.17, 147.21; 211/134, 187, 153

[56] References Cited

U.S. PATENT DOCUMENTS

| | | | |
|---|---|---|---|
| 3,463,433 | 8/1969 | Stein et al. | 108/108 |
| 4,620,489 | 11/1986 | Albano | 108/105 |
| 4,660,477 | 4/1987 | Kortering et al. | 108/108 |
| 4,718,354 | 1/1988 | Piretti | 108/143 X |
| 4,934,645 | 6/1990 | Breslow | 108/108 X |
| 5,390,802 | 2/1995 | Pappagallo et al. . | |
| 5,474,412 | 12/1995 | Pfeiffer et al. | 211/187 X |
| 5,546,826 | 8/1996 | Yanagisawa | 108/143 X |
| 5,715,957 | 2/1998 | Merl | 211/187 |
| 5,720,230 | 2/1998 | Mansfield | 108/108 |
| 5,738,019 | 4/1998 | Parker . | |
| 5,799,588 | 9/1998 | Engel | 108/108 |

FOREIGN PATENT DOCUMENTS

| | | | |
|---|---|---|---|
| 1224213 | 6/1960 | France | 108/108 |

*Primary Examiner*—Peter M. Cuomo
*Assistant Examiner*—Hanh V. Tran
*Attorney, Agent, or Firm*—Banner & Witcoff, Ltd.

[57] ABSTRACT

An extendable shelf assembly mounted on a first and a second slotted upright, comprising a first extender bar having slots and being affixed to the first slotted upright, a second extender bar having slots and being affixed to the second slotted upright, [the first extender bar including slots,] a front rail, a back rail, a first side rail and a second side rail cooperatively defining a shelf frame, and a first and a second rotatable sprocket affixed to the shelf frame. The shelf frame slides between a plurality of fixed positions along the extender bar as the first sprocket engages the slots of the first extender bar and the second sprocket engages the slots of the second extender bar. The first and second sprockets are affixed to an axle that runs parallel to the back rail. The first and second sprockets comprises a plurality of teeth that engage the slots of the extender bars. The extendable shelf assembly may further comprise a position locking mechanism affixed to the shelf frame, the position locking mechanism comprising a tab and an extension, the extension engaging one of the slots of the first extender bar and preventing the shelf frame from sliding between positions. The extendable shelf assembly may also comprise a metal biasing apparatus coupled to the shelf frame, the biasing apparatus engaging the extension and forcing the extension to enter one of the slots of the first extender bar.

17 Claims, 7 Drawing Sheets

FIG. 2
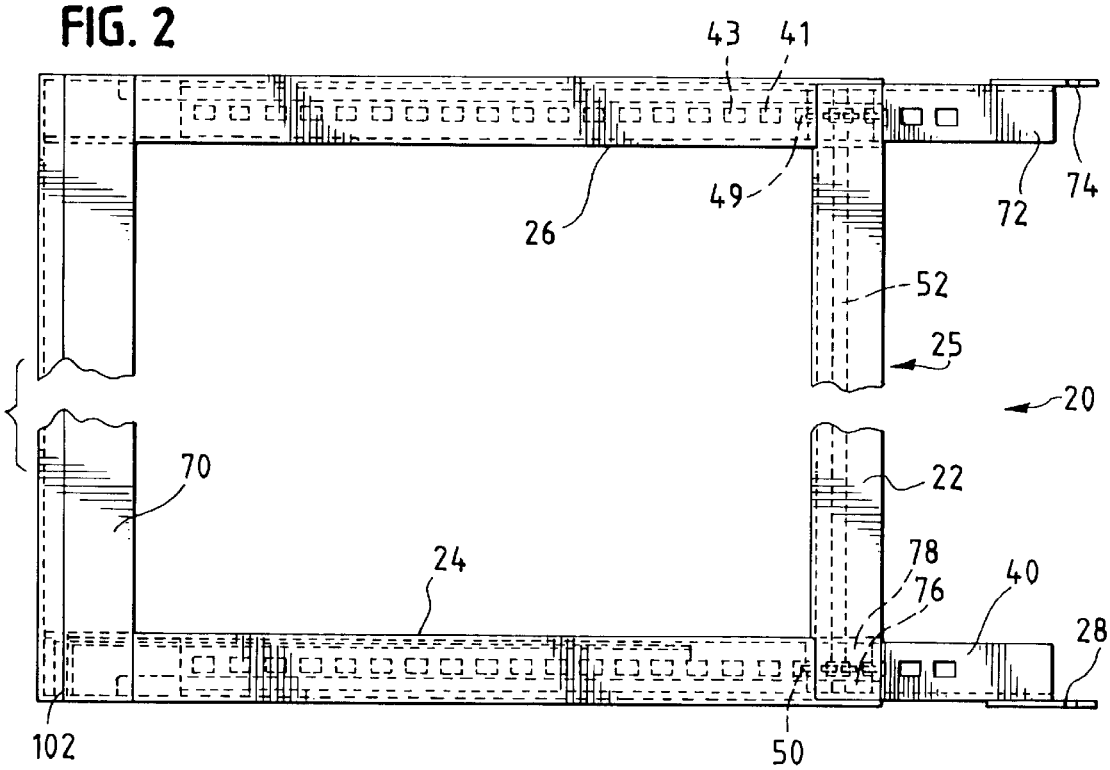
FIG. 3
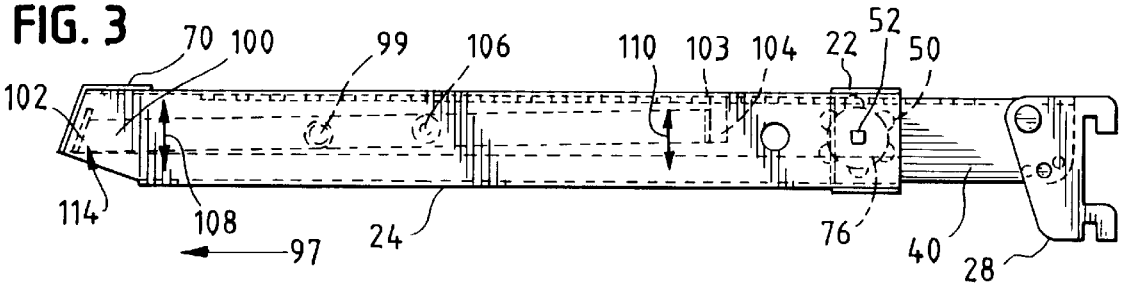
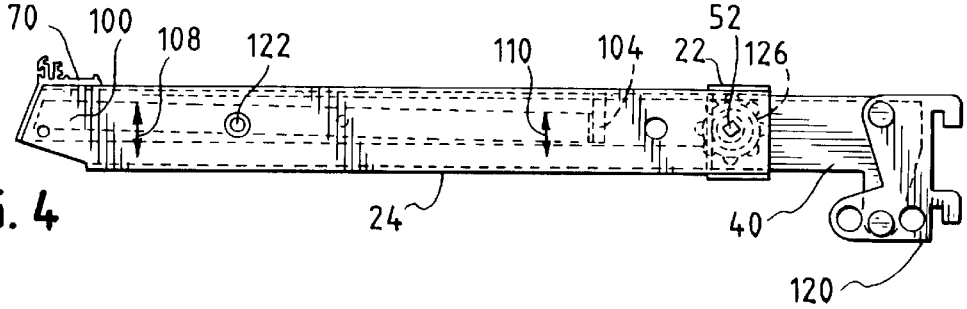
FIG. 4
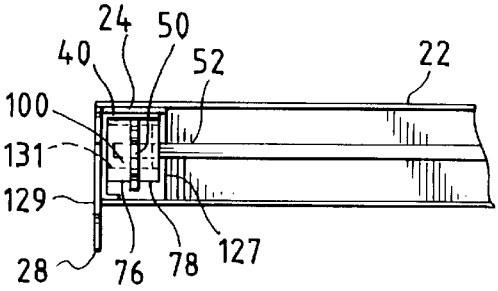
FIG. 5

FIG. 6
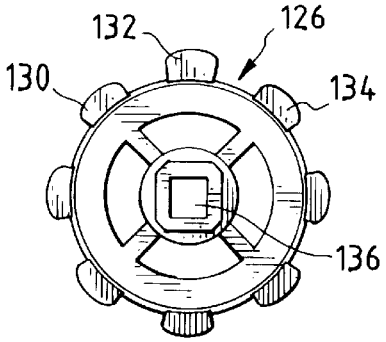
FIG. 7
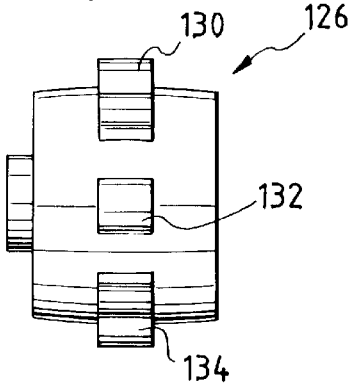
FIG. 8
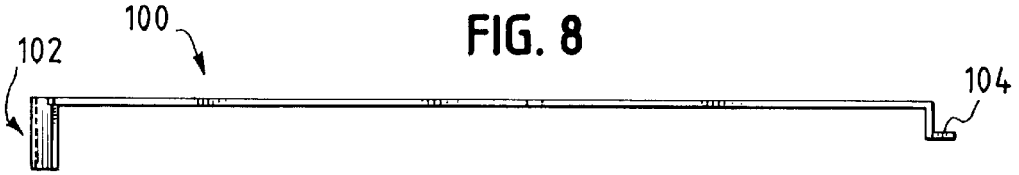
FIG. 9
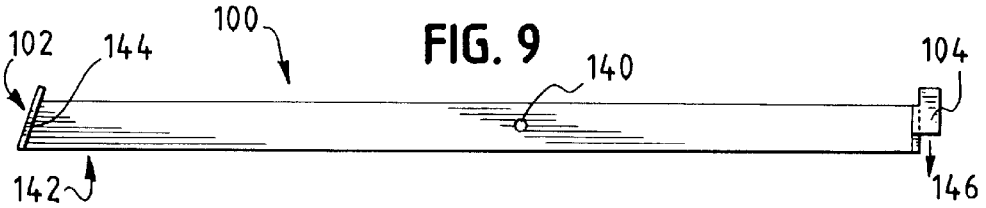
FIG. 10
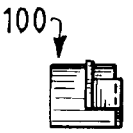
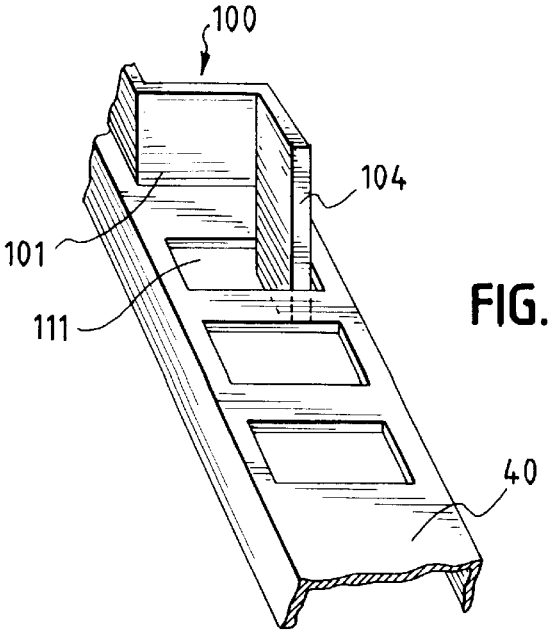
FIG. 11

ANTI-RACKING PULL-OUT SHELF

FIELD OF THE INVENTION

The present invention relates generally to an adjustable shelf assembly for use in merchandising display stands including a pair of vertically slotted spaced uprights or standards. More specifically, the invention is directed to improved mechanisms for extending and locking shelves.

BACKGROUND OF THE INVENTION

Retail store locations, such as drug stores, grocery stores and toy stores, require a large amount of shelving both to store merchandise and to display the merchandise to consumers. The shelving should be inexpensive, easy to install and capable of housing and displaying a large number of items. To satisfy these requirements, many retail store locations use gondola shelving systems. Gondola shelving systems typically employ long metal gondola shelves attached to slotted gondola uprights. These systems can be quickly and inexpensively assembled and are widely used in retail store locations.

In certain environments, it is advantageous if the shelf apparatus slides to an extended position. When in such an extended position, the contents on the shelf may be more easily viewed and accessed. In particular, a shelf apparatus that slides to an extended position allows for more efficient stocking.

Prior art systems have employed standard uncoordinated drawer glides. However, when a shelf on standard drawer glides is moved in or out, "racking" and binding may result. That is, unless equal pulling force is applied across the longitudinal surface of the shelf, the shelf often extends unevenly, i.e. in a non-perpendicular direction, from the glides and thus becomes jammed in the glides. Therefore, in prior art systems, sliding an extendable shelf has typically required the use of two hands to prevent the shelf from binding in the glides. In other words, equal pulling force had to be applied to the shelf at two locations or the shelf would become misaligned relative to the system, and the shelf would become jammed.

In certain merchandising and stocking situations, it may be preferable to lock the shelf assembly in a fully extended or non-extended position. In addition, as the shelf is extended to one of various extended positions, it is also preferable to lock the shelf assembly in each of the extended positions. It is additionally desirable to employ a locking apparatus that requires only a single hand to operate.

Further details of prior art shelving systems are explained in U.S. Pat. No. 4,934,645, "Shelving Assembly," and U.S. patent application Ser. No. 08/596,301 "Adjustable Shelf Assembly For Merchandising Display Stand," which are expressly incorporated in this application by reference.

Thus, an object of the present invention is an improved category management shelf system. An additional object of the invention is a low cost universal shelving system with improved functions for retailer product restocking and consumer shopping. A further object of the invention is a category management shelf frame that can be easily extended. Additionally, an object of the invention is an extendable shelf frame with a locking mechanism to prevent unwanted extension of the shelf.

SUMMARY OF THE INVENTION

In a preferred embodiment of the invention, a shelf frame that includes a pair of rotatable sprockets slides along slotted openings on two arms. An extendable shelf assembly is mounted on a first and a second slotted upright. The shelf assembly comprises a first extender bar affixed to the first slotted upright and a second extender bar affixed to the second slotted upright. The first extender bar and second extender bar both include multiple slots. The shelf assembly further comprises a front rail, a back rail, a first side rail and a second side rail that cooperatively define a shelf frame. A pair of rotatable sprockets are affixed to the shelf frame. The sprockets engage the slots of the extender bars. The shelf frame slides between a first position and a second extended position along the extender bar.

The rotatable sprockets are affixed to an axle that runs parallel to the back rail. Both sprockets comprise a plurality of teeth. The teeth engage the slots of the extender bars. The axle may be square.

The invention may also include a position locking mechanism affixed to the shelf frame. The position locking mechanism comprises a tab and an extension. The extension engages one of the slots of the first extender bar and prevents the shelf frame from sliding between the first position and the second extended position.

In addition, the invention may include a metal biasing apparatus coupled to the shelf frame. The biasing apparatus engages the extension and forces the extension to enter one of the slots of the first extender bar.

Further, the invention may include a bracket that affixes the first extender bar to the first slotted upright.

The invention may additionally include a stopping device extending from the first extender bar. The stopping device engages the first sprocket and prevents the shelf assembly from sliding off the first extender bar.

The shelf frame may be rotatable to a non horizontal position. Similarly, the shelf frame may be rotatable to a plurality of non horizontal positions.

BRIEF DESCRIPTION OF THE DRAWINGS

Preferred embodiments of the present invention are described with reference to the following figures:

FIG. 2 is an overhead elevational view of the shelf assembly of the embodiment of FIG. 1;

FIG. 3 is a side elevational view of the shelf assembly of FIG. 2 with a position locking mechanism shown in dashed lines in the locked position;

FIG. 4 is a side elevational view of a similar shelf assembly of FIG. 3 with the position locking mechanism in the unlocked position;

FIG. 5 is a rear elevational view of the shelf assembly of FIG. 2;

FIG. 6 is a side elevational view of a sprocket used in the invention;

FIG. 7 is another side elevational view of the sprocket of FIG. 6;

FIG. 8 is an overhead elevational view of a position locking mechanism used in the invention;

FIG. 9 is a side elevational view of the position locking mechanism of FIG. 8;

FIG. 10 is a rear elevational view of the position locking mechanism of FIG. 8;

FIG. 11 is a front oblique upside down view of the position locking mechanism of FIG. 8 engaging a slot of an extender arm;

DETAILED DESCRIPTION OF THE PREFERRED EMBODIMENTS

Figure 1:
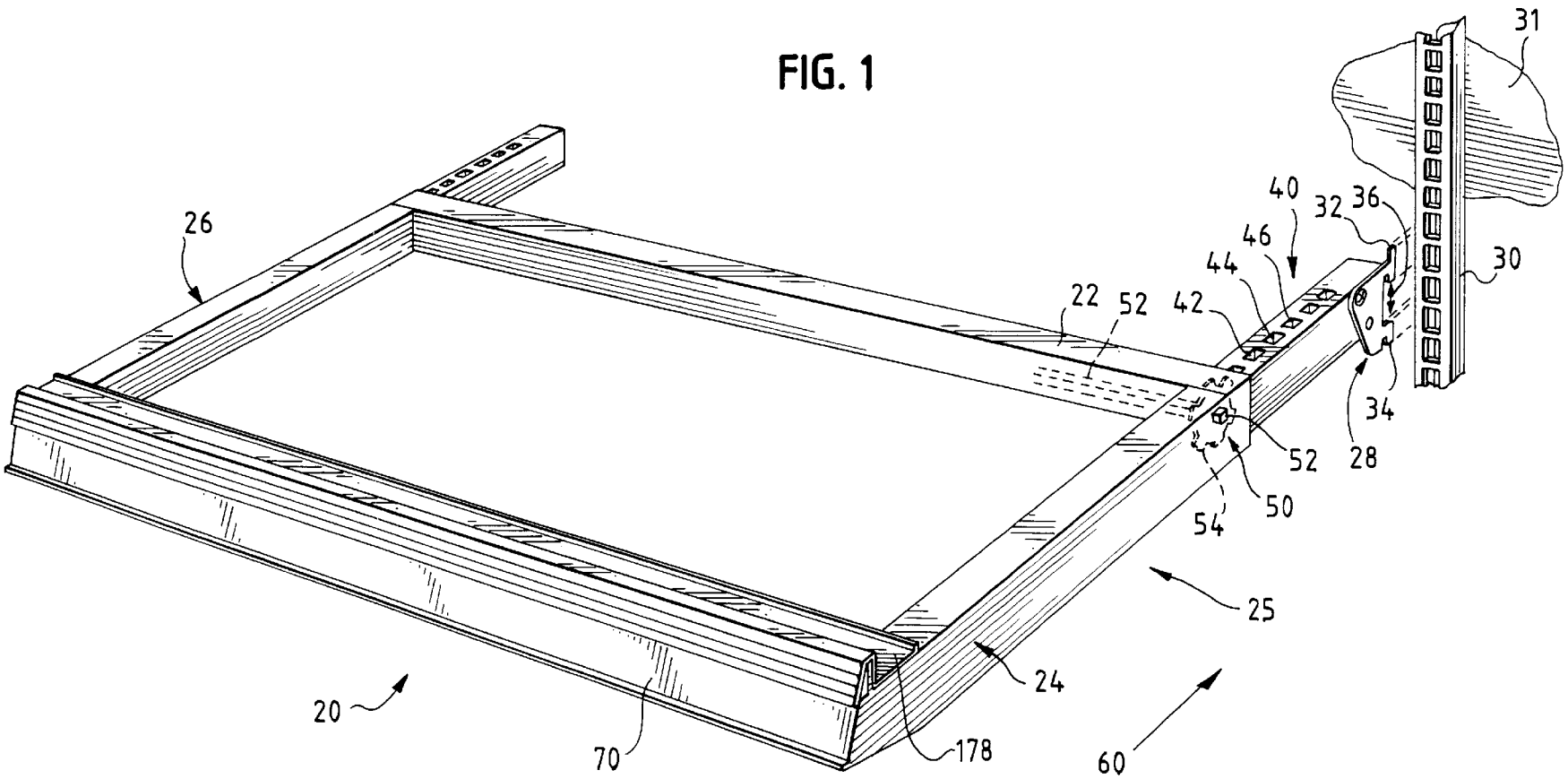
FIG. 1 is a front oblique view of a preferred embodiment of the universal category management shelf system.

Referring to FIG. 1, a preferred embodiment of a shelf assembly 20 of the present invention includes a back cross rail 22, a side rail 24, a side rail 26 and a front cross rail 70, which together define a shelf frame 25. A gondola bracket 28 connects to a slotted upright or standard 30. Specifically, tabs 32 and 34 are fitted into slots in the upright 30 as indicated by the dashed lines shown at 36. The upright 30 is typically attached to a back wall 31.

FIG. 1 shows the shelf frame 25 in a partially extended position. The shelf frame 25 slides along an internal rack arm or extender arm 40 that includes a series of slots 42, 44, 46. A rotating wheel also referred to as a cog or sprocket 50 is attached to the back cross rail 22 via an axle 52. The axle 52 is preferably square.

The sprocket 50 includes teeth, including, for example, a tooth 54. The teeth of the sprocket 50 engage the slots 42, 44, 46 of the extender arm 40 as the shelf frame 25 slides from a partially open position, as shown in FIG. 1, to a closed position, along the direction shown by the arrow 60. Similarly, the shelf frame 25 may slide to a fully open or extended position by sliding in the direction opposite the arrow 60.

Referring to FIG. 2, the invention also employs a second sprocket 49, not shown in FIG. 1, at the opposite end of the axle 52. Preferably, the second sprocket 49 is identical to the first sprocket 50, and includes multiple teeth for engaging slots 41, 43 of the side rail 26.

Further details of the shelf assembly 20 are also shown in FIG. 2, which shows the back cross rail 22, the side cross rails 24, 26 and a front cross rail 70, which together define the shelf frame 25. The mounting bracket 28 and a mounting bracket 74 affix the shelf assembly 20 to the slotted uprights (not shown). The sprocket 50 is attached to the axle 52, and sprocket washers 76, 78 are situated on either side of the sprocket 50 on the axle 52. In a preferred embodiment, the sprocket 50 and sprocket washers 76, 78 are molded into a single piece from nylon or other suitable material. The shelf frame 25 slides along the extender arm 40 and an extender arm 72.

The use of a first sprocket 50 and second sprocket 49 that engage slots on the cross rails 24, 26 eliminates "racking" and binding when a shelf frame 25 is moved in or out. The teeth of the sprockets engage slots on the cross rails 24, 26 and insure that a pulling or pushing force is evenly applied such that the shelf frame 25 slides in a perpendicular direction to the upright 30 or the back wall 31.

Referring to FIG. 3, which shows a side elevational view of the shelf assembly of FIG. 2, a mounting bracket 28 attaches the internal rack arm 40 to the slotted upright (not shown). The sprocket washer 76 helps to couple the sprocket 50 to the axle 52.

FIG. 3 also illustrates details of a position locking mechanism or locking lever 100 that prevents the shelf frame 25 from sliding along the extender arms 40, 72. The position locking mechanism 100 includes a tab 102 and extends from the tab 102 to an extension 104 that fits into one of the slots, for example slot 103, on the arm 40. The position locking mechanism 100 is affixed to the side rail 24 by a bolt 99 and washer (not shown) and is rotatable in the direction indicated by arrows 108, 110 about the bolt 106.

As is discussed in more detail later, the extension 104 is biased, for example by piece of steel (not shown) to extend into the slot 103, preventing the arm 40 from moving forward or backward, thus preventing the shelf frame 25 from sliding along the arm 40. In order to slide the shelf frame 25 forward or backward, a user depresses the tab 102 by applying force with a finger in the direction indicated by the arrow 114. Accordingly, the position locking mechanism 100 rotates about the axis defined by the bolt 106, and the extension 104 slides out of the slot 103, as is shown in FIG. 4.

The position locking mechanism 100 engages the same slots that the sprocket 50 engages, resulting in multiple locking positions of the shelf frame 25. In other words, the shelf frame 25 may be locked at each position that a tooth of the sprockets 49, 50 engage the respective slots in the side rails 26, 24.

Because dual sprocket and slot engagement results in the shelf frame 25 sliding evenly along the rails 24, 26, the invention requires only a single position locking mechanism 100. In other words, the position locking mechanism 100 is only required along one of the side rails 24, 26. In the FIGURES, the single position locking mechanism is only located along the side rail 24, and not along the side rail 26, although the position locking mechanism 100 could also be employed along only the side rail 26 and not along the side rail 24. This implementation reduces the cost of a locking slidable shelf frame.

FIG. 4 depicts the position locking mechanism 100 in the released position such that the side rail 24 can slide along the arm 40. FIG. 4 also depicts other alternative forms of the invention including a rotatable mounting bracket 120. Additionally, a stopping device, such as a bolt or other removable barrier 122 and nut (not shown) combination is in a different location than the bolt 106 and nut combination of FIG. 3. FIG. 4 also depicts an alternative sprocket 126 affixed to the axle 126.

FIG. 5 depicts a back view of the sprocket 50 affixed to the axle 52 with washers 76, 78. The position locking mechanism 100 is shown in dashed lines. FIG. 5 also shows the back rail 22, the mounting bracket 28, the arm 40 and the side rail 24. The sprocket 50 rotates on the axle 52 between an inner plate 127 and outer plate 129 of the rail 24. A wall 131 of the arm 40 is between the sprocket 50 and the outer plate 129 of the rail 24.

Referring back to FIG. 3, a stopping device, such as a bolt or nut 99 attached extends from the inside wall 131 of the arm 40. As the shelf frame 25 is extended in the direction of the arrow 97, the nut 99 eventually comes into contact with the sprocket 50, preventing the shelf frame 25 from being extended any further from this fully extended position.

Further details of the sprocket 126 are shown in FIG. 6 and FIG. 7. The sprocket 126 includes a series of teeth, including a tooth 130, a tooth 132, a tooth 134 and a square opening 136 that fits around the square axle 52. The sprocket 126 is preferably molded into a single piece from nylon.

Details of the structure and operation of the position locking mechanism 100 are shown in FIGS. 8, 9, 10, 11, 12 and 13. FIG. 9 shows the position locking mechanism 100, including the tab 102 and the extension 104, from the same perspective as in FIG. 3 and FIG. 4. The position locking mechanism 100 is affixed to a side rail by a bolt and nut pair through an opening or hole 140. As explained in more detail later, a biasing apparatus, for example a piece of metal attached to the rail 24 by a bolt, is used to maintain the position locking mechanism in a locked position, that is, engaging one of the slots on the arm 40. The position locking mechanism 100 is preferably made of 14 gauge steel.

Figure 12:
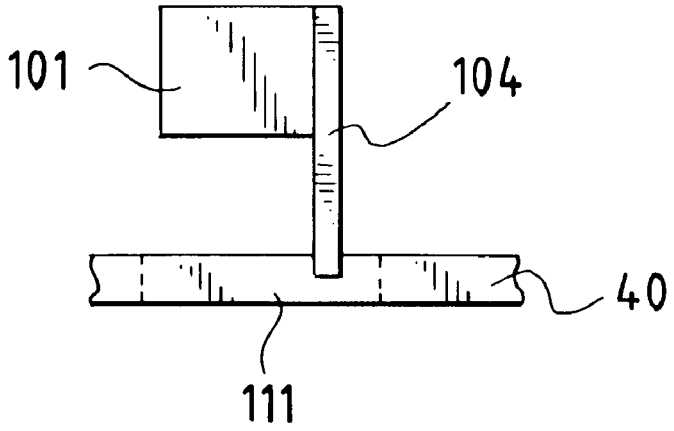
FIG. 12 is a front elevational view of the position locking mechanism of FIG. 11.
Figure 13:
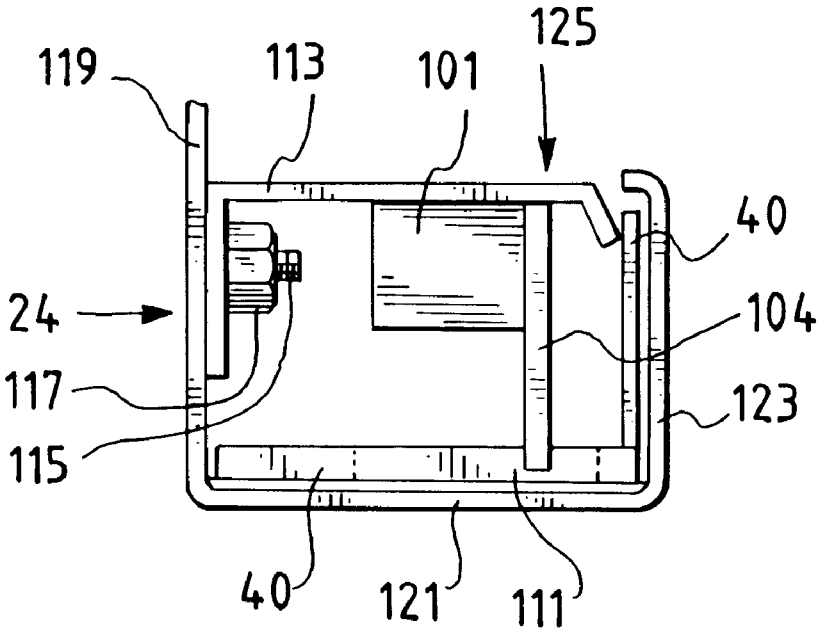
FIG. 13 is a front elevational view as in FIG. 12 depicting a biasing apparatus holding the position locking mechanism in position.

Referring to FIGS. 11, 12 and 13 which are upside down views, the position locking mechanism 100 includes a plate 101 and the extension 104 that extends into a slot, for example slot 111 of the arm 40. The extension 104 is maintained within the slot 111 by a biasing apparatus, as shown in FIG. 13, preferably a soft metal piece 113 that is affixed by a bolt 15 and nut 117 to an inner wall 119 of the rail 24. The metal piece 113 applies a force in the direction indicated by arrow 125, pushing the extension 104 into the slot 111. FIG. 13 also illustrates a top wall 121 and outer wall 123 of the rail 24.

Referring back to FIG. 9, as force is applied, for example by a finger, in the direction indicated by the arrow 142 against the surface 144, the extension 104 moves downward in the direction indicated by the arrow 146, disengaging the slot of the arm 40. Referring to FIG. 13, the extension 104 moves in the direction opposite the arrow 125 so that the extension 104 no longer engages the slot 111 in the arm 40. Thus, the rail 24 may freely slide along the arm 40. Referring again to FIG. 9, the surface 144 preferably includes a thin layer of a soft spongy material for improved feel and control when the surface is touched by a finger. The invention preferably includes a single position locking mechanism 100 in the shelf assembly 20 to allow for one-handed release of the lever and one handed sliding of the shelf frame 25 along the arms 40, 72. Two release levers may be employed, for example, to reduce the possibility of accidental unlocking of the position locking mechanism.

Figure 14:
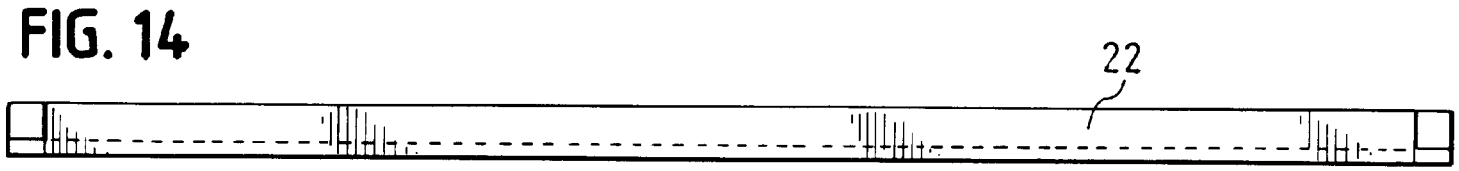
FIG. 14 is a front elevational view of a back rail used in the invention.
Figure 15:
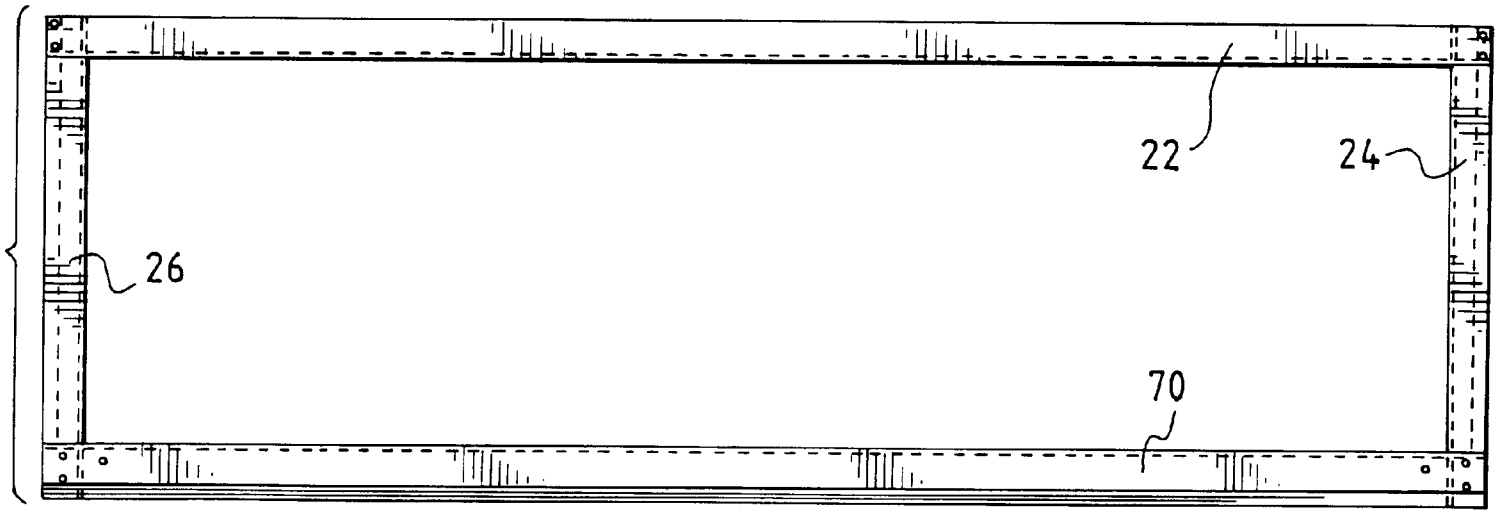
FIG. 15 is an overhead elevational view of a shelf frame used in the invention.
Figure 17:
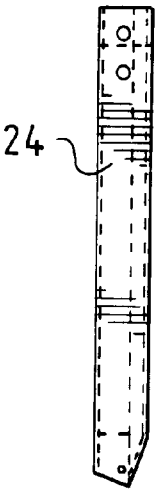
FIG. 17 is a side elevational view of a side rail of FIG. 15.
Figure 16:
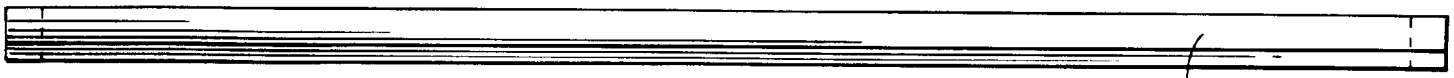
FIG. 16 is a front elevational view of the front rail of FIG. 15.

Further details of the shelf frame 25 and its components are illustrated in FIGS. 14, 15, 16 and 17. FIG. 14 shows the back rail 22, FIG. 16 shows the front rail 70, FIG. 17 shows the side rail 24, and FIG. 15 shows the shelf frame 25 including the side rails 24, 26, the front rail 70 and the back rail 22.

Figure 18:
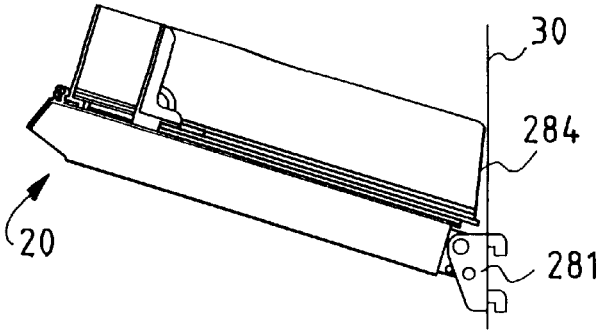
FIG. 18 is a side elevational view of a shelf assembly including a divider tilted upwardly at a 17 degree angle.
Figure 19:
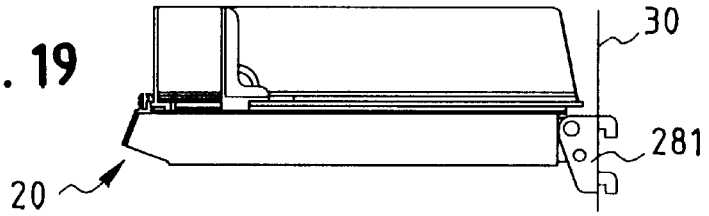
FIG. 19 is a side elevational view of the shelf assembly of FIG. 18 in a level horizontal position.
Figure 20:
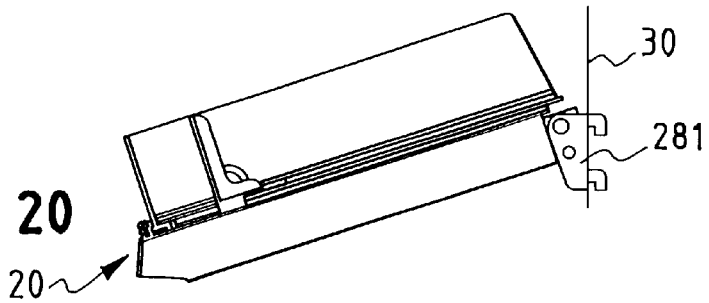
FIG. 20 is a side elevational view of the shelf assembly of FIG. 19 tilted downward at a 17 degree angle.
Figure 21:
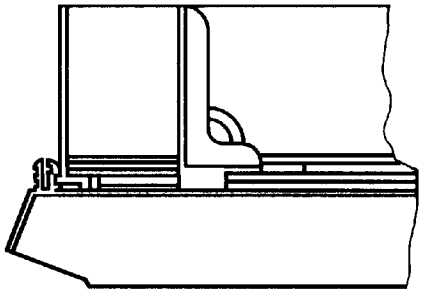
FIG. 21 is a close up side elevational view of the embodiment of FIG. 19.
Figure 22:
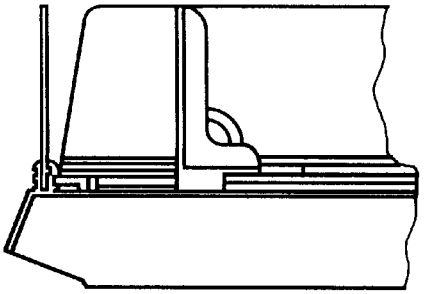
FIG. 22 is a close up side elevational view of an embodiment similar to FIG. 21 including a different divider arrangement.

Various configurations of the shelf apparatus 20 are shown in FIGS. 18, 19 and 20. FIG. 18 shows the shelf assembly 20 mounted to the upright 30 and tilted upwardly at a 17 degree angle. FIG. 19 shows the shelf assembly of FIG. 18 in a level horizontal position, and FIG. 20 shows the shelf assembly of FIG. 19 tilted downward at a 17 degree angle. The different mounting angles depend on the arrangement of a mounting bracket 281.

Figure 23:
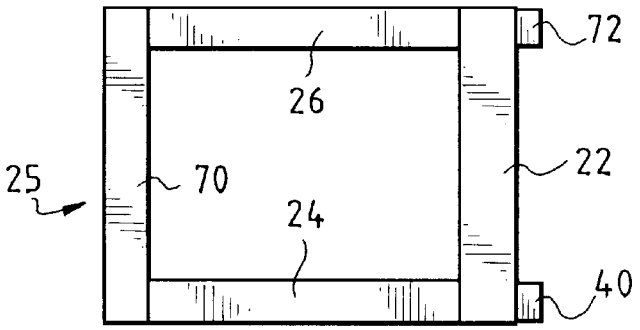
FIG. 23 is an overhead elevational view of the shelf assembly of FIG. 2 with the shelf frame in a retracted or closed position.
Figure 24:
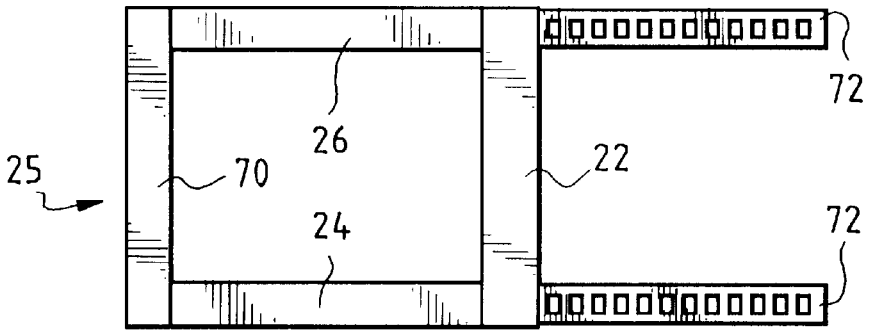
FIG. 24 is an overhead elevational view of the shelf assembly of FIG. 23 with the shelf frame in a fully open or extended position.
Figure 25:
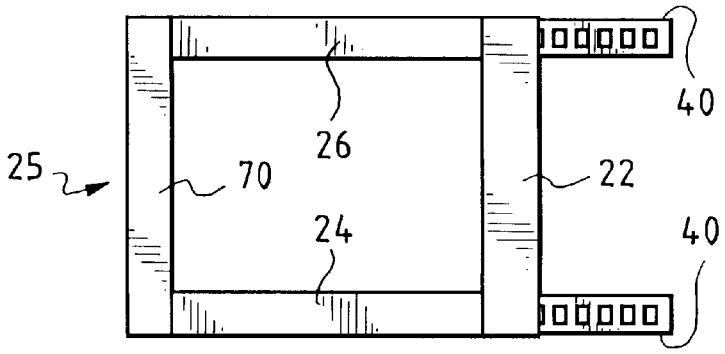
FIG. 25 is an overhead elevational view of the shelf assembly of FIG. 24 with the shelf frame in a partially open or extended position.

Sample views of the shelf frame 25 in three different representative positions are shown in FIGS. 23, 24 and 25. FIG. 23 shows the shelf frame 25 in a retracted or closed position. FIG. 24 shows the shelf frame 25 in a fully open or extended position. Similarly, FIG. 25 shows the shelf frame 25 in a partially open or extended position. The shelf frame may also be extended to multiple other positions and is limited only by the frequency of the teeth and slot engagement between the sprockets and the side rails. In addition, the shelf frame 25 is locked by the position locking mechanism 100 in each position.

In a preferred embodiment of the invention, the rails 22, 24, 26, 70, the arm 40 and the axle 52 are made of steel of various gauges, as one skilled in the art would know.

It is to be understood that alternative forms of the various components of the described embodiments are covered by the full scope of equivalents of the claimed invention. To particularly point out and distinctly claim the subjects regarded as the invention, the following claims conclude this specification.

I claim:

1. An extendable shelf assembly mounted on a first slotted upright and a second slotted upright, comprising:

a first extender bar affixed to the first slotted upright, the first extender bar including a series of slots;

a second slotted extender bar affixed to the second slotted upright, the second extender bar including a series of slots;

a front rail, a back rail, a first side rail and a second side rail, defining a shelf frame;

a first rotatable sprocket and a second rotatable sprocket affixed at opposite ends to an axle that runs parallel to the back rail, the first rotatable sprocket comprising a first plurality of teeth, and the second rotatable sprocket comprising a second plurality of teeth, the first and second rotatable sprockets preventing misalignment of the shelf frame by successive teeth of the first and second pluralities of teeth engaging successive slots of the first and second extender bars, respectively, as the shelf frame slides between a plurality of fixed positions along the first and second extender bars, including at least a first position and a second extended position.

2. The extendable shelf assembly as in claim 1 further comprising a single position locking mechanism affixed to the shelf frame, the position locking mechanism comprising a tab and an extension, the extension engaging one of the slots of the first extender bar and preventing the shelf frame from sliding between the first position and the second extended position.

3. The extendable shelf assembly as in claim 2 further comprising a metal biasing apparatus coupled to the shelf frame, the biasing apparatus engaging the extension and forcing the extension to enter one of the slots of the first extender bar.

4. The extendable shelf assembly as in claim 3 further comprising a removable barrier extending from the first extender bar, the removable barrier engaging the first sprocket and preventing the shelf frame from sliding off the first extender bar.

5. The extendable shelf assembly as in claim 4 wherein the axle is square.

6. The extendable shelf assembly as in claim 5 wherein the shelf frame is rotatable to a non horizontal position.

7. The extendable shelf assembly as in claim 6 wherein the shelf frame is rotatable to a plurality of non horizontal positions.

8. The extendable shelf assembly as in claim 7 further comprising a first bracket affixing the first extender bar to the first slotted upright and a second bracket affixing the second extender bar to the second slotted upright.

9. The extendable shelf assembly as in claim 1 further comprising a metal biasing apparatus coupled to the shelf frame, the biasing apparatus engaging an extension and forcing the extension to enter one of the slots of the first extender bar.

10. The extendable shelf assembly as in claim 1 further comprising a removable barrier extending from the first extender bar, the removable barrier engaging the first sprocket and preventing the shelf assembly from sliding off the first extender bar.

11. The extendable shelf assembly as in claim 1 wherein the axle is square.

12. The extendable shelf assembly as in claim 1 wherein the shelf frame is rotatable to a non horizontal position.

13. The extendable shelf assembly as in claim 1 wherein the shelf frame is rotatable to a plurality of non horizontal positions.

14. The extendable shelf assembly as in claim 1 further comprising a bracket affixing the first extender bar to the first slotted upright.

15. An extendable shelf assembly mounted on the slotted uprights of a merchandising display stand comprising:

a front cross rail coupled to a first side rail and a second side rail;

a back cross rail coupled to the first side rail and the second side rail, the front cross rail, first side rail, second side rail and back cross rail defining a shelf frame;

a first gondola bracket coupled to the slotted uprights;

a second gondola bracket coupled to the slotted uprights;

a first internal rack arm including a series of slots, the first internal rack arm affixed to the first gondola bracket;

a second internal rack arm including a series of slots, the second internal rack arm affixed to the second gondola bracket;

an axle extending parallel to the back cross rail, the axle affixed to the first side rail and the second side rail;

a first rotatable sprocket mounted to the axle; and a second rotatable sprocket mounted to the axle, successive teeth of the first and second sprockets preventing misalignment of the shelf frame by engaging the successive slots in the first and second internal rack arms, respectively, as the shelf frame slides along the first internal rack arm and along the second internal rack arm between a plurality of preset positions.

16. The extendable shelf assembly of claim 15 further comprising:

a position locking mechanism coupled to the first side rail, the position locking mechanism comprising an extension that engages the slots of the first internal rack arm and preventing the rack arm from sliding between a first extended position and the second extended position.

17. An extendable shelf assembly mounted on a first slotted upright and a second slotted upright, comprising:

a first extender bar affixed to the first slotted upright, the first extender bar including a series of slots;

a second slotted extender bar affixed to the second slotted upright, the second extender bar including a series of slots;

a front rail, a back rail, a first side rail and a second side rail cooperatively defining a shelf frame;

a first rotatable sprocket and a second rotatable sprocket affixed at opposite ends to an axle that runs parallel to the back rail, the first rotatable sprocket comprising a first plurality of teeth, and the second rotatable sprocket comprising a second plurality of teeth, the first and second rotatable sprockets preventing misalignment of the shelf frame by successive teeth of the first and second pluralities of teeth engaging successive slots of the first and second extender bars, respectively as the shelf frame slides between a plurality of fixed positions along the first and second extender bars, including at least a first position and a second extended position, a single position locking mechanism affixed to the shelf frame, the position locking mechanism comprising a tab and an extension, the extension engaging one of the slots of the first extender bar and preventing the shelf frame from sliding between the first position and the second extended position;

a metal biasing apparatus coupled to the shelf frame, the biasing apparatus engaging the extension and forcing the extension to enter one of the slots of the first extender bar; and a stopping device extending from the first extender bar, the stopping device engaging the first sprocket and preventing the shelf assembly from sliding off the first extender bar.

* * * * *